United States Patent [19]

Baird et al.

[11] B 4,014,829

[45] Mar. 29, 1977

[54] FLAME RESISTANT FIBER BLENDS

[75] Inventors: Bennett Ray Baird, Camden, S.C.; Leander Adair Sherbeck, Waynesboro, Va.

[73] Assignee: E. I. Du Pont de Nemours and Company, Wilmington, Del.

[22] Filed: Oct. 30, 1974

[21] Appl. No.: 519,355

[44] Published under the second Trial Voluntary Protest Program on April 13, 1976 as document No. B 519,355.

[52] U.S. Cl. ..... 260/17.2; 8/21 B; 8/116 P; 8/171; 260/9; 260/17.3; 260/45.7 P; 260/841; 260/849; 260/850; 260/851; 260/856; 260/857 PE; 260/857 F; 260/857 UN; 260/DIG. 24

[51] Int. Cl.[2] ..... C08L 1/02

[58] Field of Search ..... 260/9, 857 PE, 857 F, 260/857 UN, 45.7 P, 841, 849, 17.2, 17.3, 856, 850, 860, 873, DIG. 24; 8/21 B, 116 P, 171

[56] References Cited

UNITED STATES PATENTS

| | | | |
|---|---|---|---|
| 3,063,966 | 11/1962 | Kwolek | 260/78 |
| 3,480,582 | 11/1969 | Brooks | 260/45.75 |
| 3,692,867 | 9/1972 | Mayer et al. | 260/857 PE |
| 3,738,804 | 6/1973 | Snider | 8/15 |

OTHER PUBLICATIONS

Chem. Absts. 79:20257y, "Flame-Retardant—guanidines," Nachbur.

Chem. Absts. 79:20256x, "Flame-Retardant—products," Nachbur.

Chem. Absts. 71:22869h, "Flame-Resistant—compounds," Evans.

*Primary Examiner*—Donald E. Czaja

*Assistant Examiner*—Edinard Woodberry

[57] ABSTRACT

A flame-resistant blend of textile fibers comprising (a) from about 20 to 40% by weight of a normally flammable textile fiber aesthetically suitable for wearing apparel and (b) from about 60 to 80% by weight of poly(metaphenylene isophthalamide) fiber containing distributed substantially throughout its whole interior a finely divided cross-linked reaction product of at least 5% by weight (unreacted basis) of a tetrakis hydroxymethyl phosphonium compound and a resin containing active hydrogen.

9 Claims, No Drawings

FLAME RESISTANT FIBER BLENDS

FIELD OF THE INVENTION

This invention relates to novel blends of textile fibers, and to yarns and fabrics composed thereof, which exhibit improved flame resistance. More particularly, the invention relates to novel, flame-resistant textile fiber blends containing a substantial portion of conventional, flammable textile fibers.

BACKGROUND OF THE INVENTION

Although the need for flame-resistant fibers has been felt for many years, the available flame-resistant fibers have generally been less than satisfactory. Early examples of flame-resistant fibers were asbestos and fiber glass, followed by fibers of polyvinylchloride, the copolymer of vinyl chloride (60%) and acrylonitrile (40%), and polytetrafluoroethylene. These fibers are generally considered to be deficient in aesthetic properties when used in garments. More recently, fibers of poly(metaphenylene isophthalamide), MPD-I, have become available. Although the MPD-I fibers are quite satisfactory for many textile uses and exhibit good flame-resistant properties, they are relatively costly. Moreover, a need has been felt to provide flame-resistant textile products having a variety of other properties and aesthetic characteristics.

In order to make use of the various aesthetic properties of conventional, flammable fibers which have been on the market for many years, it has been proposed to blend them with flame-retardant fibers in proportions sufficient to make the blend nonflammable. It might be assumed that the burning propensity of a fiber blend of flammable and nonflammable fibers would decrease roughly in proportion to the amount of nonflammable fiber present, by dilution of the flammable material. The disclosure of U.S. Pat. No. 3,480,582 suggests that such a dilution principle may apply in the case of fiber blends used for carpets, which are heavy fabrics tested for flammability in horizontal position. This flammability test is a relatively mild one, since the burning gases rise from the fabric under test. Fabrics intended for apparel use are tested by a more stringent test in which the fabrics are mounted vertically and ignited at the bottom, so that the burning gases rise around and through areas of fabric not yet consumed by the flames. In this test, it is usually found that fabrics made of blends of flame-retardant fibers with conventional, flammable fibers actually burn more readily than fabrics made solely of the flammable fibers. Although there are various explanations for this phenomenon, one reason appears to be that the nonflammable fibers hold the flammable fibers in place, so that they cannot shrink away from the flame. Only when the nonflammable fibers constitute a very high proportion (i.e., about 85% or higher) of the total material present is the blend found to be nonflammable. From the aesthetic viewpoint, fabrics containing such a high proportion of the nonflammable fiber are usually essentially equivalent to fabrics made solely of the nonflammable fiber. Accordingly, it has been desired to make fabrics containing higher proportions of the conventional, flammable fibers.

SUMMARY OF THE INVENTION

The present invention provides a flame-resistant blend of textile fibers comprising (a) from about 60% to 80% by weight of a poly(metaphenylene isophthalamide) (briefly referred to herein as MPD-I) fiber containing distributed substantially throughout its whole interior a finely divided cross-linked reaction product of at least 5% by weight (unreacted basis) of a tetrakis hydroxymethyl phosphonium compound and a resin containing active hydrogen and (b) from about 20% to 40% by weight of a normally flammable textile fiber aesthetically suitable for wearing apparel. The amount of the phosphorus-containing fiber in the blend will normally be the minimum amount that is sufficient to render fabrics of the fiber blend flame resistant. By this is meant nonflammable when tested by the vertical flame test method described herein.

The preferred normally flammable textile fibers aesthetically suitable for wearing apparel are polyethylene terephthalate fibers in the amount of about 20–40% of the blend with MPD-I fiber; cotton fibers in the amount of about 20–30% of the blend with MPD-I fiber; and acrylic fibers in the range of about 20–25% of the blend with MPD-I fiber. By normally flammable textile fiber is meant a fiber which in fabric form would fail the vertical flame test.

The surprising finding of the present invention is that the normally flammable textile fibers can be blended with the phosphorus-containing poly(metaphenylene isophthalamide) fibers in quantities sufficiently large that the aesthetic properties of the blend in fabric form are significantly changed by the presence of the flammable fibers.

DESCRIPTION OF THE INVENTION

The phosphorus-containing poly(metaphenylene isophthalamide) fibers employed in the present invention may be prepared by extruding a solution of poly(metaphenylene isophthalamide) in a solvent comprised essentially of dimethylacetamide (DMAc) together with an ionized salt through a multi-hole spinneret into a heated vertical cell. The preparation of the polymer is described in more detail in U.S. Pat. No. 3,063,966, and the spinning of the polymer is described in U.S. Pat. No. 3,360,598. Most of the DMAc is evaporated as the fibers pass through the heated cell, and the filaments emerging from the bottom of the cell are flooded and quenched with an aqueous liquid, resulting in water-swollen fibers. The filaments are further extracted and drawn while being passed through a multi-tank apparatus containing heated aqueous baths, such as described in U.S. Pat. No. 3,725,523. The water-swollen filaments contain approximately one part of water per part of polymer, and are maintained in the wet condition (never permitted to dry) prior to their treatment with a phosphorus compound and a resin compound. The water-swollen filaments are immersed in an aqueous solution of tetrakis hydroxymethyl phosphonium compound, a reactive resin compound, and optionally a catalyst. After permitting the filaments to soak long enough so that no further significant change takes place in the solute concentration of the swollen filaments, the filaments are removed from the bath, dried, and heat-cured, thereby generating finely divided cross-linked phosphorus-containing resin deposits substantially throughout the interior of the filaments. The tetrakis hydroxymethyl phosphonium compound is preferably tetrakis hydroxymethyl phosphonium chloride (THPC), but may also be tetrakis hydroxymethyl phosphonium oxide (THPO) or a reactive derivative thereof. At least 5% but preferably no more than about 20% by weight (unreacted basis) of the phosphonium compound should be incorporated in the fiber. Further details of the preparation of the phosphorus containing poly(metaphenylene isophthalamide) fibers may be found in copending applications Ser. No. 383,083 filed July 26, 1973 and Ser. No. 451,984 filed Mar. 18, 1974.

The resin component is preferably both water soluble and reactive at elevated temperature with the phosphorus compounds to form a cross-linked, insoluble product; yet reactive only at a very slow rate at ambient temperatures with the phosphorus compound to permit maximum lifetime of the treating solution. Preferred resin components are condensates of melamine formaldehyde (such as "Aerotex UM" from American Cyanamid Co.), phenolformaldehyde, and hexamethylol melamine. These components may optionally be combined with other reactive materials such as guanidine phosphate. A catalyst such as ammonium chloride or magnesium chloride, which facilitates the reaction between the phosphorus compound and resin component at elevated temperature, may optionally also be included.

The drying and heat-curing step is carried out for a suitable time at a suitable temperature, usually for about 15 minutes at about 170°C. For the purpose of the present invention, sufficient reaction has occurred when the phosphorus/resin deposits have become insoluble in DMAc containing 4% lithium chloride, a solvent for the MPD-I fibers (in some instances, the entire fiber plus deposits will become insoluble in this solvent).

The phosphorus-containing poly(metaphenylene isophthalamide) fibers may be blended with any of a variety of normally flammable textile fibers aesthetically suitable for wearing apparel. Such fibers include cotton, rayon, cellulose acetate, wool, nylon, acrylic, and polyester fibers as well as other fibers normally employed for making comfortable garments and other fabrics designed to be comfortable in contact with the skin. At least 20%, preferably 25% or more, of the fiber blend should be comprised of the normally flammable textile fibers aesthetically suitable for wearing apparel. In general, at least 60% of the phosphorus-containing poly(metaphenylene isophthalamide) fiber must be present to render the blend nonflammable when tested by the vertical flame test method. The amount of phosphorus-containing polymetaphenylene isophthalamide) fiber required to render the blend nonflammable varies somewhat depending on the nature of the other fiber. For polyester fibers 60% of the phosphorus-containing fiber should preferably be present; for cotton fibers 70% should preferably be present; and for acrylic fibers 75% should preferably be present. The fiber blends are prepared by usual textile methods.

By blending the flammable fibers with the phosphorus-containing poly(metaphenylene isophthalamide) fibers, the aesthetics of fabrics produced from yarns made from the fibers can be varied. Thus, by blending polyethylene terephthalate fibers with the phosphorus-containing poly(metaphenylene isophthalamide) fibers, the textile processability of the fibers is increased and the pilling performance and crease resistance of the fabrics is improved. Fabrics of enhanced bulkiness can be produced by blending the phosphorus-containing poly(metaphenylene isophthalamide) fibers with acrylic fibers of different shrinkage level. Static propensity can be reduced by employing blends with cotton fibers.

In the examples below, fabrics are tested for flammability in accordance with the vertical flame test.

Vertical flame test - Fabrics are tested for flammability in accordance with the vertical flame test method identified as DOC FF 3-71, Standard for the Flammability of Children's Sleepwear, as published in the Federal Register, Vol. 36, No. 146, pages 14062–14073, Thursday, July 29, 1971; except that butane gas is employed instead of methane, the burner is mounted below the fabric vertically instead of at an angle, and the number of samples tested range from two to eight (the number of samples being stated for each of the tests reported).

EXAMPLE I

Polyester Fiber Blends

A. Stock Tow Preparation

A filtered spinning solution is prepared consisting of 18.5%, based on the weight of the solution, of poly(metaphenylene isophthalamide) in N,N-dimethylacetamide (DMAc) that contains 45% calcium chloride, based on the weight of the polymer. The polymer has an inherent viscosity of 1.60 as measured in a 0.5% solution in DMAc/4% LiCl at 25°C. The spinning solution is heated to 133°–140°C. and dry spun through multi-hole spinnerets. The extruded filaments are converged at a guide at the bottom of each cell where they are flooded with an aqueous solution containing 7–10% DMAc and 5–7% calcium chloride. Filaments from several adjacent cells are combined to give a large bundle of filaments, referred to as a "tow", each filament being about 12 dpf as spun.

The wet tow is fed at 71 meters/min. to a 10-tank apparatus wherein the tow is extracted and drawn in stages, a total of about 4.2X draw, in aqueous baths, the temperatures of the aqueous baths ranging from 82°C. in the first three baths by stages to 98°C. in the last bath. Finish is applied to the wet tow, and the filaments are crimped in a steamed stuffer-box crimper. The crimped, never-dried filaments are stored wet in a sealed container.

B. Preparation of the Phosphorus-Containing Fibers

The crimped, never-dried filaments of poly(metaphenylene isophthalamide) are treated in stock dyeing procedure with a solution of 72% (based on the weight of the filaments) of THPC (tetrakis hydroxymethyl phosphonium chloride), 18% (based on the weight of the filaments) melamine-formaldehyde resin (Aerotex UM), and 0.4% (based on the weight of the filaments) of ammonium chloride as a catalyst. The never-dried tow is soaked for 60 minutes at 80°C. in the solution of the flame retarder and the resin. The liquor is then drained from the tow and the resin in the tow is cured by drying at 135°C. for 1.5 hours. The tow is then scoured, rinsed, dried, and cut to staple. The phosphorus-containing staple fiber product of poly(metaphenylene isophthalamide) so produced contains 6% THPC and is referred to below as Fiber I-B.

C. Preparation of Polyester Fiber Blends and Fabrics

1. Double Knit Fabrics — A staple fiber blend of 75% of Fiber I-B and 25% polyethylene terephthalate staple fibers is prepared, and the staple fiber blend is spun to a 20/1 cc. (cotton count) yarn of 13.5Z twist and knitted into a 5.8 ounce/yd.$^2$ double knit fabric. In a vertical flame test (4 samples), the char length was 1.5 inch and the after flame extinguishes itself in 3 seconds.

In a control test, a blend of 25% polyethylene terephthalate staple fibers with unmodified poly(metaphenylene isophthalamide) staple fibers containing no phosphorus is prepared and spun to a 20/1 cc. yarn of 13.5Z twist. A 5.8 ounce/yd.$^2$ double knit fabric is knitted from this control yarn. This control fabric fails the vertical flame test (1 sample burns of 4 tested).

2. Jersey Knit Fabrics — Fiber I-B is blended with polyethylene terephthalate staple fibers in various proportions, as indicated in the table below. The staple fiber blends are spun to 20/1 cc. yarns of 13.5Z twist and knitted into a 4.2 ounce/yd.$^2$ jersey knit fabric. The flame resistance of the fabrics so produced is determined in the vertical flame test. As shown in the table, fabrics made of yarns containing from 25 to 40% of the polyethylene terephthalate fibers (75 –60% of Fiber I-B) pass the vertical flame test. However, fabrics containing higher proportions of the polyethylene terephthalate staple fibers fail to pass the vertical flame test and are regarded as unsatisfactory.

VERTICAL FLAME TEST OF FABRICS OF POLYETHYLENE TEREPHTHALATE/PHOSPHORUS-CONTAINING POLY(METAPHENYLENE ISOPHTHALAMIDE)

| Polyethylene Terephthalate Content | No. of Samples | Char Length | Duration of After Flame |
|---|---|---|---|
| 25% | 2 | 1.5 in. | 2 sec. |
| 30% | 6 | 2.0 | 2 |
| 35% | 6 | 2.0 | 4 |
| 40% | 8 | 2.0 | 4 |
| Unsatisfactory Fabrics | | | |
| 45% | 4 | One sample burns | |
| 50% | 3 | One sample burns | |

3. Batiste Fabrics — A staple fiber blend of 60% of Fiber I-B and 40% polyethylene terephthalate staple fibers is prepared, and the staple fiber blend is spun to a 30/1 cc. yarn of 13.5Z twist and woven into a 3.0 oz./yd.$^2$ batiste fabric. In a vertical flame test (5 samples), the char length is 3.0–4.0 inches and the after flame extinguishes itself in 3 seconds.

In a control test, a blend of 55% of Fiber I-B and 45% polyethylene terephthalate staple fibers is similarly spun to a 20/1 cc. yarn and woven into a batiste fabric. However, this fabric fails the vertical flame test (three samples burn of five tested).

EXAMPLE II

Cotton Blends

A staple fiber blend of 75% of Fiber I-B, prepared as described in Part B of Example I above, and 25% cotton is prepared. The staple fiber blend is spun to a 20/1 cc. yarn of 13.5Z twist and knitted into a 5.8 ounce/yd.$^2$ double knit fabric. In the vertical flame test (two samples), the char length is 1.5 inches and the after flame extinguishes itself in 3 seconds. A similar blend of 70% Fiber I-B and 30% cotton, when spun into yarn and knitted into a double knit fabric, gives similar results. However, a staple fiber blend of 60% of Fiber I-B and 40% cotton, when spun into yarn and knitted into a double knit fabric, fails the vertical flame test (both samples burning of two tested).

In a control test, a blend of 25% cotton with 75% unmodified poly(metaphenylene isophthalamide) staple fibers containing no phosphorus is prepared and spun to a 20/1 cc. yarn of 13.5Z twist. A 5.8 ounce/yd.$^2$ double knit fabric is knitted from this control yarn. This control fabric fails the vertical flame test (both samples burning of two tested).

EXAMPLE III

Acrylic Fiber Blends

A staple fiber blend is prepared from 75% of Fiber I-B, prepared as described in Part B of Example I above, and 25% of a commercially available acrylic fiber (Orlon acrylic fiber, produced by E. I. du Pont de Nemours & Co., Inc.). The staple fiber blend is spun to a 20/1 cc. yarn of 13.5Z twist and knitted into a 5.8 ounce/yd.$^2$ double knit fabric. In the vertical flame test (four samples), the char length is 1.5 inches and the after flame extinguishes itself in 3 seconds. However, a staple fiber blend of 70% of Fiber I-B and 30% acrylic fiber, when spun into yarn and knitted into a double knit fabric, fails the vertical flame test (both samples burning of two tested).

In a control test, a blend of 25% acrylic fiber with 75% unmodified poly(metaphenylene isophthalamide) staple fibers containing no phosphorus is prepared and spun to a 20/1 cc. yarn of 13.5Z twist. A 5.8 ounce/yd.$^2$ double knit fabric is knitted from this control yarn. This control fabric fails the vertical flame test (both samples burning of two tested).

EXAMPLE IV

Flame Resistance After Laundering

Phosphorus-containing staple fibers of poly(metaphenylene isophthalamide) are prepared as described in Part B of Example I, except that the resin in the tow is cured by steaming the treated tow in an autoclave at 20 psig. for 45 minutes, and the fibers so produced contain 7% THPC. The phosphorus-containing poly(metaphenylene isophthalamide) fibers are blended with polyethylene terephthalate staple fibers in various proportions, as indicated in the table below. The staple fiber blends are spun to 20/1 cc. yarns of 13.5Z twist. Jersey knit (4.2 ounce/yd.$^2$) and double knit (9.1 ounce/yd.$^2$) fabrics are prepared from the yarns, as in Example I. The fabrics are washed 50 times in home laundry cycles and exposed to ultraviolet radiation 40 hours in a Xenometer (20 hours on each side of the fabric). After two more washing and drying cycles, the samples are subjected to the vertical flame test. A 3.0 ounce/yd.$^2$ batiste fabric of a 20/1 cc. yarn of 13.5Z twist spun from 65% of Fiber I-B and 35% polyethylene terephthalate staple fibers is prepared and subjected to the same cycle of washing, ultraviolet radiation, final washing, drying, and flame testing. The results of the flame testing are given in the table below. As shown by the results, the blend fabrics are quite flame-resistant even after repeated laundering.

VERTICAL FLAME TEST AFTER EXTENSIVE LAUNDERING: POLYETHYLENE TEREPHTHALATE/PHOSPHORUS-CONTAINING POLY(METAPHENYLENE ISOPHTHALAMIDE)

| Polyethylene Terephthalate Content | Fabric Construction | No. of Samples | Char Length |
|---|---|---|---|
| 30% | Jersey | 5 | 0.75 |
| 35% | " | 5 | 1.0 |
| 40% | " | 5 | 0.75 |
| 40% | Double knit | 5 | 0.50 |
| 35% | Batiste | 2 | 5.0 |

The properties of the blends of the invention are quite unexpected, and not simply due to the presence of the THPC in the poly(metaphenylene isophthalamide) fiber. Very different results are obtained when poly(paraphenylene terephthalamide) fiber is employed in place of poly(metaphenylene isophthalamide) fiber as shown by the following comparative example.

COMPARATIVE EXAMPLE

Polyester Fiber Blends with THPC-Containing PPD-T Fibers

Never-dried 1.0 dpf filaments wet-spun from a sulfuric acid solution of poly(paraphenylene terephthalamide) are treated in a stock dyeing procedure with an aqueous solution of THPC, 10% melamine-formaldehyde resin (Aerotex UM), 4.12% of a dye, and 0.4% ammonium chloride as a catalyst, all percentages being based on the weight of the filaments. The solution is circulated at +15°C. for 30 minutes, after which it is heated up to 80°C. and recirculated at this temperature for 30 minutes. The liquor is then drained from the filaments and the resin in the filaments is cured by drying at 135°C. for 1.5 hours. The filaments are then scoured, rinsed, dried, and cut to staple. The phosphorus-containing staple fiber product of poly(-paraphenylene terephthalamide) so produced contains 5.7% THPC and is referred to below as Fiber C.

A staple fiber blend of 60% of Fiber C and 40% polyethylene terephthalate staple fibers is prepared, and the staple fiber blend is spun to 20/1 cc. yarn of 13.5Z twist and knitted into a 4.2 ounce/yd.$^2$ jersey knit fabric. The flame resistance of the fabrics so produced is determined in a vertical flame test. The burner was placed in a vertical position rather than at a 45° angle in these tests. All samples burned (5 samples). In these tests it appeared that the polyester fibers burned from the fabrics over their entire lengths, leaving a charred but still rather strong matrix of poly(paraphenylene terephthalamide) fibers.

As noted in the table in Example I, a fabric of the same weight made of 40% blend of polyethylene terephthalate fibers with 60% poly(metaphenylene isophthalamide) fibers containing 6% THPC is flame resistant.

What is claimed is:

1. A flame-resistant blend of textile fibers comprising (a) from about 20 to 40% by weight of a normally flammable textile fiber aesthetically suitable for wearing apparel and (b) from about 60 to 80% by weight of poly(metaphenylene isophthalamide) fiber containing distributed substantially throughout its whole interior a finely divided cross-linked reaction product of a tetrakis hydroxymethyl phosphonium compound selected from the group consisting of tetrakis hydroxymethyl phosphonium chloride, tetrakis hydroxymethyl phosphonium oxide and reactive derivatives thereof and a resin containing active hydrogen selected from the group of melamine formaldehyde, phenolformaldehyde and hexamethylol melamine, the phosphonium compound being present in an amount of from 5–20% by weight (unreacted basis) of the poly(metaphenylene isophthalamide) fiber.

2. The composition of claim 1 wherein component (a) is cotton.

3. The composition of claim 2 wherein the cotton constitutes from about 20% to about 30% by weight of the blend.

4. The composition of claim 1 wherein component (a) is an acrylic fiber.

5. The composition of claim 4 wherein the acrylic fiber constitutes from about 20% to about 25% by weight of the blend.

6. The composition of claim 1 wherein component (a) is a polyester fiber.

7. The composition of claim 1 wherein said phosphonium compound is tetrakis hydroxymethyl phosphonium chloride.

8. The composition of claim 1 wherein the resin is melamine formaldehyde.

9. A flame-resistant fabric prepared from the fiber blend of claim 1.

* * * * *